US010920586B2

(12) United States Patent
Al-Qasim et al.

(10) Patent No.: US 10,920,586 B2
(45) Date of Patent: Feb. 16, 2021

(54) SYSTEMS AND METHODS FOR LOGGING WHILE TREATING

(71) Applicant: Saudi Arabian Oil Company, Dhahran (SA)

(72) Inventors: Abdulaziz Al-Qasim, Dhahran (SA); Alberto Marsala, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 101 days.

(21) Appl. No.: 16/235,310

(22) Filed: Dec. 28, 2018

(65) Prior Publication Data

US 2020/0208513 A1 Jul. 2, 2020

(51) Int. Cl.

| | |
|---|---|
| ***E21B 47/00*** | (2012.01) |
| ***E21B 23/14*** | (2006.01) |
| ***E21B 49/00*** | (2006.01) |
| ***E21B 37/00*** | (2006.01) |
| *E21B 47/002* | (2012.01) |

(52) U.S. Cl.
CPC ..... *E21B 49/00* (2013.01); *E21B 37/00* (2013.01); *E21B 47/002* (2020.05)

(58) Field of Classification Search
CPC ..... E21B 23/14; E21B 23/001; E21B 47/00; G01V 11/005
See application file for complete search history.

(56) References Cited

U.S. PATENT DOCUMENTS 3,764,969 A 10/1973 Cubberly
4,635,718 A 1/1987 Thomas
4,945,987 A * 8/1990 Wittrisch ..... E21B 23/14 166/250.17
5,042,297 A 8/1991 Lessi
5,517,024 A 5/1996 Mullins et al.
5,942,043 A 8/1999 Suemune
5,947,213 A * 9/1999 Angle ..... E21B 47/002 175/24
6,112,809 A * 9/2000 Angle ..... E21B 17/1021 166/66

(Continued)

FOREIGN PATENT DOCUMENTS

CN 106761390 A 5/2017
WO 2017007469 A1 1/2017

OTHER PUBLICATIONS

International Search Report and Written Opinion for related PCT application PCT/US2019/068533 dated Apr. 2, 2020.

*Primary Examiner* — Kipp C Wallace
(74) *Attorney, Agent, or Firm* — Bracewell LLP; Constance G. Rhebergen; Linda L. Morgan

(57) ABSTRACT

Systems and methods for measuring properties within a subterranean well include a measuring tool having a tool body with a central axis and a tool attachment located at an axial end of the tool body. A delivery line attachment is operable to attach the measuring tool to a delivery line that supports the measuring tool within the subterranean well. A primary treatment platform is in mechanical communication with the tool body. The primary treatment platform has a platform attachment sized to mate with the tool attachment, and at least one treatment system. The at least one treatment system is operable to perform a treatment function within the subterranean well during delivery of the measuring tool into the subterranean well.

24 Claims, 4 Drawing Sheets

(56) References Cited

U.S. PATENT DOCUMENTS

| | | | | |
|---|---|---|---|---|
| 6,378,627 | B1 * | 4/2002 | Tubel | E21B 17/1078 175/24 |
| 7,669,469 | B2 * | 3/2010 | Shammai | E21B 49/082 73/152.23 |
| 7,719,439 | B2 | 5/2010 | Pratt et al. | |
| 8,220,541 | B2 * | 7/2012 | Martinez | E21B 41/00 166/250.01 |
| 8,235,144 | B2 | 8/2012 | Rasheed | |
| 9,512,713 | B2 | 12/2016 | Ahmed et al. | |
| 9,874,093 | B2 | 1/2018 | Skerry | |
| 10,267,140 | B2 * | 4/2019 | Andreychuk | G01V 1/008 |
| 2010/0288492 | A1 | 11/2010 | Blackman et al. | |
| 2011/0083845 | A1 | 4/2011 | McLaughlin | |
| 2012/0048560 | A1 | 3/2012 | Soni et al. | |
| 2013/0081459 | A1 | 4/2013 | Memiche | |
| 2015/0184508 | A1 | 7/2015 | Huang et al. | |
| 2016/0215578 | A1 * | 7/2016 | Adnan | E21B 23/14 |
| 2016/0356145 | A1 * | 12/2016 | Andreychuk | E21B 47/002 |
| 2017/0306724 | A1 | 10/2017 | Forstner et al. | |

* cited by examiner

SYSTEMS AND METHODS FOR LOGGING WHILE TREATING

BACKGROUND OF THE DISCLOSURE

1. Field of the Disclosure

The disclosure relates generally to hydrocarbon development operations in a subterranean well, and more particularly to measuring properties of a formation during and after well drilling operations.

2. Description of the Related Art

Well logging in gas and oil wells play an important role in making decisions related to well placement, intervention type and reservoir strategy. Wellbores are monitored as they are being drilled or by post-drilling operations such as production and saturation logging tools.

SUMMARY OF THE DISCLOSURE

Well logging can be challenging due to difficult wellbore conditions, such as obstructions within the bore due to cuttings, remaining filter cakes, waxy materials and other debris within the bore that can prevent the logging tools from moving downhole through the bore or from being retrieved. Obstructions within a bore can be particularly troublesome at locations where a subterranean well changes direction, or in deviated or horizontal portions of the bore. Obstructions can further damage the logging tool during deployment and retrieval of the logging tool.

Embodiments of this disclosure include systems and methods for providing a treatment platform that is integrated with the logging tool. The treatment platform can identify and clear obstructions within the bore that are downhole of the logging tool or uphole of the logging tool. The treatment platform is stackable to allow for the deployment of multiple treatment platforms, is heavy weight and can include textured surfaces. The treatment platforms can have the capability of providing thermal intervention, chemical treatment intervention, and mechanical intervention. The treatment platform can be deployed ahead of the logging tool by a desired distance, behind the logging tool by a desired distance, or can be deployed while attached directly to a downhole or uphole end of the logging tool body.

In an embodiment of this disclosure, a system for measuring properties within a subterranean well includes a measuring tool having a tool body with a central axis and a tool attachment located at an axial end of the tool body. A delivery line attachment is operable to attach the measuring tool to a delivery line that supports the measuring tool within the subterranean well. A primary treatment platform is in mechanical communication with the tool body. The primary treatment platform has a platform attachment sized to mate with the tool attachment. The primary treatment platform further includes at least one treatment system. The at least one treatment system is operable to perform a treatment function within the subterranean well during delivery of the measuring tool into the subterranean well.

In alternate embodiments, the primary treatment platform can be rotatable around the central axis. The at least one treatment system can include a vibration system operable to vibrate the primary treatment platform. The primary treatment platform can alternately include a textured surface positioned to engage an obstruction of the subterranean well. The at least one treatment system can include one of a heat delivery, a chemical treatment system, and combinations thereof. The primary treatment platform can alternately include a monitoring system, the monitoring system including one of a camera, a sensor, a caliper, and combinations thereof.

In other alternate embodiments, the primary treatment platform can further include a sample storage space. The system can further include a secondary treatment platform, the secondary treatment platform having a secondary platform connector sized to engage the primary treatment platform. The delivery line can be one of a wireline or coiled tubing. The platform attachment can circumscribes a portion of the tool body. Alternately, the primary treatment platform can be spaced axially apart, and separate from, the tool body and a rope can extend between the tool body and the primary treatment platform.

In alternate embodiments of the disclosure, a method for measuring properties within a subterranean well include supporting a measuring tool within the subterranean well with a delivery line. The measuring tool has a tool body with a central axis and a tool attachment located at an axial end of the tool body. A delivery line attachment attaches the measuring tool to the delivery line. A primary treatment platform is in mechanical communication with the tool body, the primary treatment platform having a platform attachment sized to mate with the tool attachment and also having at least one treatment system. A treatment function is performed within the subterranean well with the at least one treatment system during delivery of the measuring tool into the subterranean well.

In alternate embodiments, the method can further include rotating the primary treatment platform around the central axis. The at least one treatment system can include a vibration system and the method can further include vibrating the primary treatment platform. The primary treatment platform can include a textured surface and the method can further include engaging an obstruction of the subterranean well with the textured surface to remove the obstruction. The treatment system can include one of a heat delivery system, a chemical treatment system, and combinations thereof.

In other alternate embodiments, the primary treatment platform can include a monitoring system, the monitoring system including one of a camera, a sensor, a caliper, and combinations thereof. The primary treatment platform can further include a sample storage space and the method can further include storing a sample of the subterranean well within the sample storage space.

In yet other alternate embodiments, the measuring tool can have a secondary treatment platform having a secondary platform connector, and the method can further include engaging the primary treatment platform with the secondary platform connector to secure the secondary platform connector to the primary treatment platform. The delivery line can be one of a wireline or coiled tubing and the method can further include delivering the measuring tool into the subterranean well with the delivery line. The platform attachment can circumscribe a portion of the tool body. Alternately, the primary treatment platform can be spaced axially apart, and separate from, the tool body and a rope can extend between the tool body and the primary treatment platform.

BRIEF DESCRIPTION OF THE DRAWINGS

So that the manner in which the previously-recited features, aspects and advantages of the embodiments of this disclosure, as well as others that will become apparent, are attained and can be understood in detail, a more particular description of the disclosure briefly summarized previously may be had by reference to the embodiments that are illustrated in the drawings that form a part of this specification. It is to be noted, however, that the appended drawings illustrate only certain embodiments of the disclosure and are, therefore, not to be considered limiting of the disclosure's scope, for the disclosure may admit to other equally effective embodiments.

DETAILED DESCRIPTION OF THE DISCLOSURE

The disclosure refers to particular features, including process or method steps. Those of skill in the art understand that the disclosure is not limited to or by the description of embodiments given in the specification. The subject matter of this disclosure is not restricted except only in the spirit of the specification and appended Claims.

Those of skill in the art also understand that the terminology used for describing particular embodiments does not limit the scope or breadth of the embodiments of the disclosure. In interpreting the specification and appended Claims, all terms should be interpreted in the broadest possible manner consistent with the context of each term. All technical and scientific terms used in the specification and appended Claims have the same meaning as commonly understood by one of ordinary skill in the art to which this disclosure belongs unless defined otherwise.

As used in the Specification and appended Claims, the singular forms "a", "an", and "the" include plural references unless the context clearly indicates otherwise.

As used, the words "comprise," "has," "includes", and all other grammatical variations are each intended to have an open, non-limiting meaning that does not exclude additional elements, components or steps. Embodiments of the present disclosure may suitably "comprise", "consist" or "consist essentially of" the limiting features disclosed, and may be practiced in the absence of a limiting feature not disclosed. For example, it can be recognized by those skilled in the art that certain steps can be combined into a single step.

Where a range of values is provided in the Specification or in the appended Claims, it is understood that the interval encompasses each intervening value between the upper limit and the lower limit as well as the upper limit and the lower limit. The disclosure encompasses and bounds smaller ranges of the interval subject to any specific exclusion provided.

Where reference is made in the specification and appended Claims to a method comprising two or more defined steps, the defined steps can be carried out in any order or simultaneously except where the context excludes that possibility.

Figure 1:
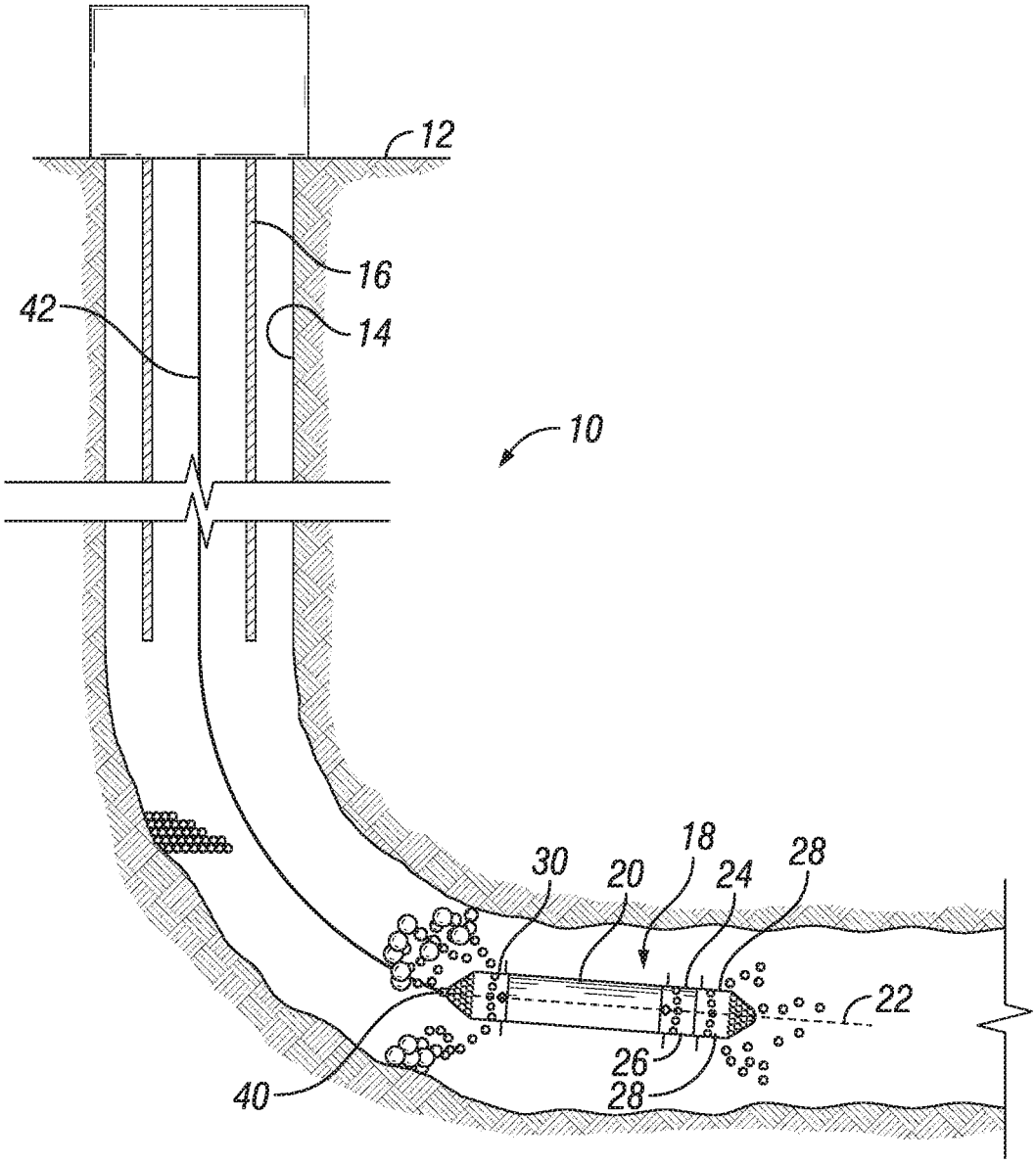
FIG. 1 is a schematic elevation sectional view of a subterranean well having a measuring tool, in accordance with an embodiment of this disclosure.

Looking at FIG. 1, subterranean well 10 extends downwards from surface 12 of the earth, which can be a ground level surface or a subsea surface. Bore 14 of subterranean well 10 can extended generally vertically relative to the surface. Alternately, bore 14 can include portions that extend generally horizontally or in other directions that deviate from generally vertically from the surface. Subterranean well 10 can be a well associated with hydrocarbon development operations, such as a hydrocarbon production well, an injection well, or a water well.

Tubular string 16 extends into bore 14 of subterranean well 10. Tubular string 16 can be, for example, a casing string, or another elongated member lowered into the subterranean well. A portion of bore 14 can include tubular string 16 and another portion of bore 14 can be open or uncased.

Figure 2:
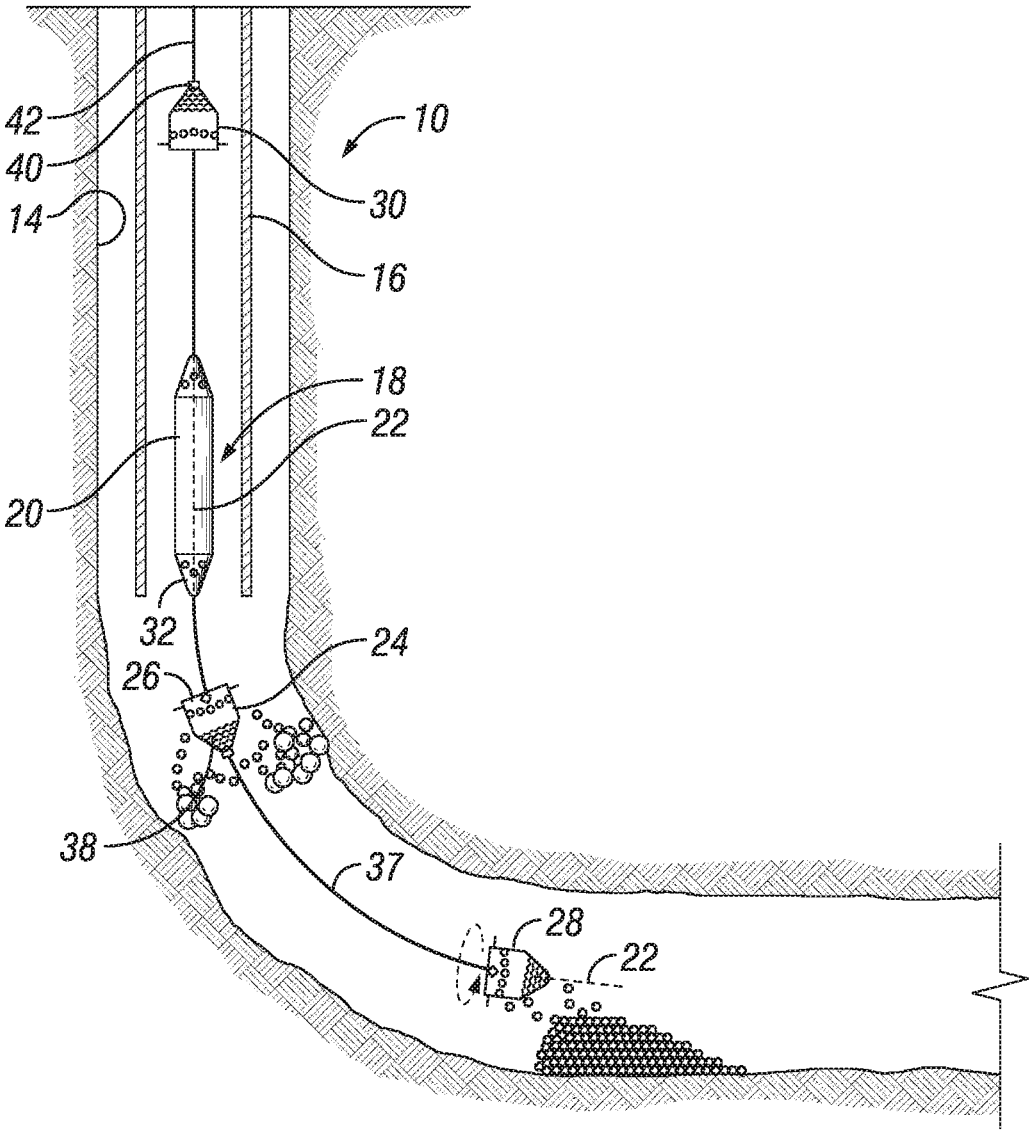
FIG. 2 is an elevation sectional view of a measuring tool located within a subterranean well, in accordance with an embodiment of this disclosure.

A system for measuring properties within subterranean well 10 includes measuring tool 18. Measuring tool 18 includes tool body 20 that is an elongated body. Measuring tool 18 has central axis 22. As can be seen in FIG. 2, when components of measuring tool 18 are located at various positions around a curve or bend of bore 14, central axis 22 will have a non-linear overall shape.

Measuring tool 18 can be a logging tool for performing logging and measuring operations within bore 14. Measuring tool 18 can measure, log, and provide information relating to subterranean well 10 such as the quality of the cement bond, the pressure and temperature of the formation, well production and saturation data, the mudflow rate, well geometry, well integrity, and formation gamma ray and resistivity.

One or more treatment platforms 24 is in mechanical communication with tool body 20. In the embodiment of FIG. 1, three treatment platforms 24 are shown, including primary treatment platform 26, secondary treatment platform 28, and third treatment platform 30. Primary treatment platform 26 is secured to a downhole axial end of tool body 20, secondary treatment platform 28 is secured to primary treatment platform 26, and third treatment platform 30 is secured to an uphole axial end of tool body 20. In alternate embodiments, measuring tool 18 can include only one treatment platform 24 or can include more than three treatment platforms 24. In other alternate embodiments, there may be one or more treatment platforms 24 secured to the downhole axial end of tool body 20 and no treatment platforms secured to the uphole axial end of tool body 20. In yet other alternate embodiments, there may be one or more treatment platforms 24 secured to the uphole axial end of tool body 20 and no treatment platforms 24 secured to the downhole axial end of tool body 20.

Figure 3:
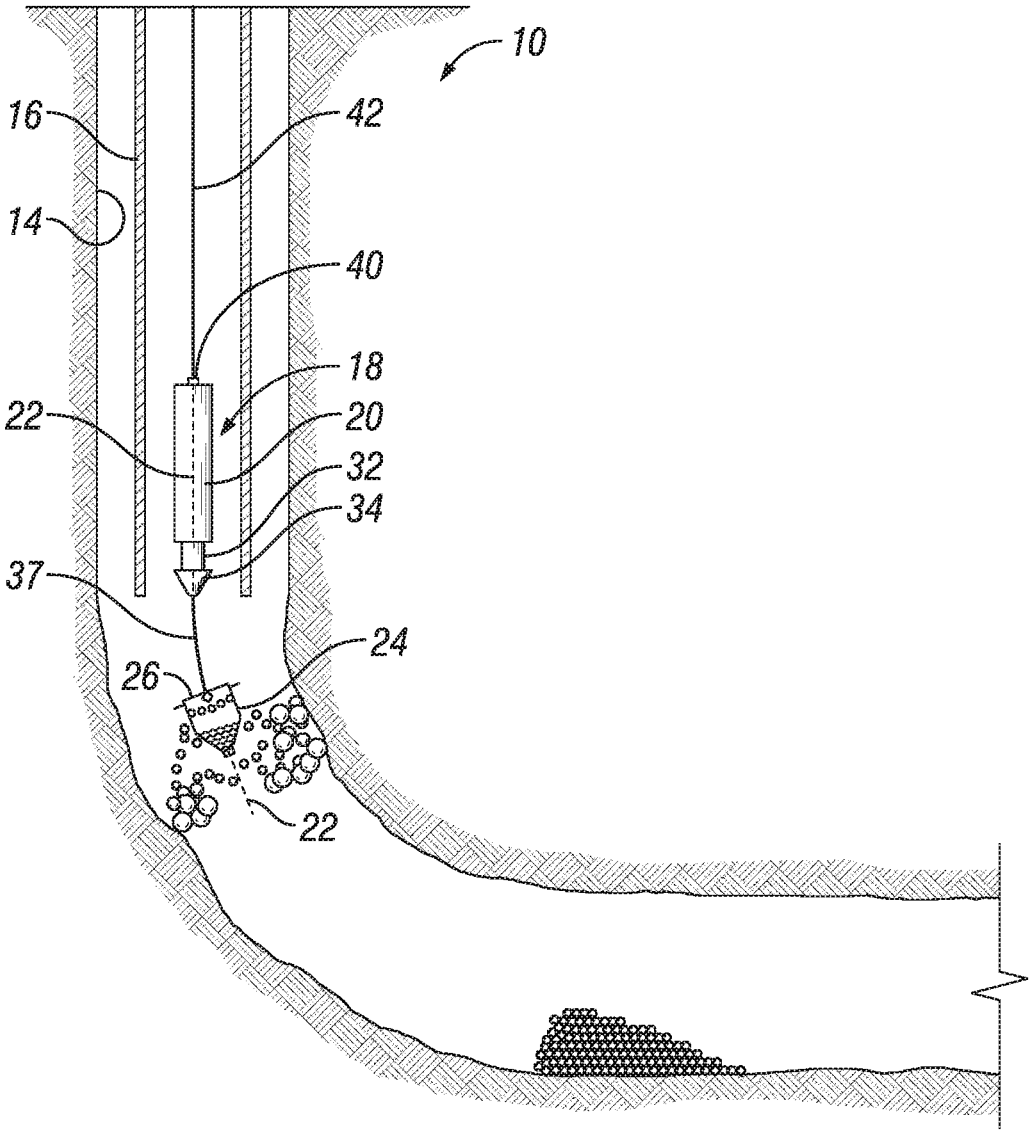
FIG. 3 is an elevation sectional view of a measuring tool located within a subterranean well, in accordance with an embodiment of this disclosure.

Looking at FIGS. 2-3, measuring tool 18 includes tool attachment 32 located at one or both axial ends of tool body 20. Tool attachment 32 can be an attachment type known in the art such as an attachment that includes operating keys, finger connectors, rope sockets, and other types of male and female connector members. In the example embodiment of FIG. 2, tool attachment 32 includes a conical shaped member that can be seated and secured within treatment platform 24 for attaching treatment platform 24 to tool body 20. In the example embodiment of FIG. 3, tool attachment 32 includes mating lip 34 that can be engaged by treatment platform 24 for attaching treatment platform 24 to tool body 20.

Figure 6:
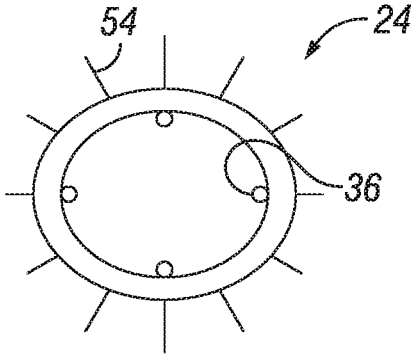
FIG. 6 is a cross sectional view of a treatment platform, in accordance with an embodiment of this disclosure.

Treatment platform 24 can include platform attachment 36 (FIG. 6). Platform attachment 36 can be a female connector that is sized and shaped to mate with tool attachment 32. For example, platform attachment 36 can include a frusto-conical recess with members that engage tool attachment 32. Alternately, platform attachment 36 can include keys, fingers, or another collet type connector for engaging tool attachment 32.

If treatment platform 24 is a secondary treatment platform 28, the platform attachment 36 is a secondary platform connector that is sized and shaped to engage primary treatment platform 26. Looking at FIG. 1, platform attachment 36 can be used to stack multiple treatment platforms 24 to one of the axial ends of tool body 20. In such an embodiment, primary treatment platform 26 can include male platform connector 38 (FIG. 2) at an end of platform connector that is opposite platform attachment 36. Male platform connector 38 and the secondary platform connector can include keys, fingers, or another collet type connector systems.

In the example configuration of FIG. 1, treatment platform 24 is directly connected to tool body 20 by way of tool attachment 32 (FIGS. 2-3) and platform attachment 36 (FIG. 6). In such a configuration platform attachment circumscribes tool attachment 32, which is a portion of tool body 20.

In the example configuration of FIG. 2, each treatment platform 24 is spaced axially apart, and separate from, tool body 20. Primary treatment platform 26 is located downhole from tool body 20 and is spaced axially apart, and separate from, tool body 20 and is located between tool body 20 and secondary treatment platform 28. Primary treatment platform 26 can be tethered to tool body 20 by rope 37 that extends between tool body 20 and primary treatment platform 26. In an embodiment, rope 37 can be formed of galvanized stainless steel wires. Rope 37 can control uphole and downhole movement of each treatment platform 24. Alternately, autonomous tractor motors can be used to control uphole and downhole movement of each treatment platform 24, particularly in horizontal or deviated wells.

Secondary treatment platform 28 is spaced axially apart, and separate from, tool body 20 and is downhole of primary treatment platform 26. Secondary treatment platform 28 can be tethered to primary treatment platform 26 by rope 37 that extends between secondary treatment platform 28 and primary treatment platform 26. Third treatment platform 30 is uphole of tool body 20 and is spaced axially apart, and separate from, tool body 20. Third treatment platform 30 can be tethered to tool body 20 by rope 37 that extends between tool body 20 and third treatment platform 30.

Looking at the example embodiments of FIGS. 1-2, primary treatment platform 26 and third treatment platform 30 can be directly secured to tool body 20, and secondary treatment platform 28 can be directly secured to primary treatment platform 26 during at least some of the time during delivery of measuring tool 18 into, or retrieval of measuring tool 18 from, bore 14 (FIG. 1). During other times during delivery of measuring tool 18 into, or retrieval of measuring tool 18 from, bore 14 primary treatment platform 26, secondary treatment platform 28 and third treatment platform 30 can be released so that each treatment platform 24 is spaced axially apart, and separate from, tool body 20 (FIG. 2).

Tool attachment 32 can be made up and released from platform attachment 36 as desired to alternately directly secure treatment platforms 24 to tool body 20 or to release treatment platforms 24 from direct attachment with tool body 20. Male platform connector 38 can be made up and released from platform attachment 36 as desired to alternately directly secure secondary treatment platform 28 to primary treatment platform 26 or to release secondary treatment platform 28 from primary treatment platform 26.

Looking at the example embodiment of FIG. 3, there is only a single treatment platform 24. In such an embodiment, treatment platform 24 can be a primary treatment platform that is located downhole from tool body 20 and is spaced axially apart, and separate from, tool body 20. Primary treatment platform 26 can be tethered to tool body 20 by rope 37 that extends between tool body 20 and primary treatment platform 26.

Measuring tool 18 further includes delivery line attachment 40. Delivery line attachment 40 is operable to attach tool body 20 to delivery line 42. Delivery line 42 supports measuring tool 18 within subterranean well 10. Delivery line 42 can be secured directly to tool body 20 (FIG. 3), or can support tool body 20 by way of one or more treatment platforms 24 that are located uphole of tool body 20 (FIG. 2). Delivery line 42 can be, for example, a wireline or coiled tubing. In embodiment including horizontal or deviated wells, delivery line 42 can be a wireline that is conveyed through tractors or alternately delivery line 42 can be coiled tubing. Delivery line 42 can be used to move measuring tool 18 in a direction into subterranean well 10 and in a direction out of subterranean well 10 for performing measuring and logging operations.

As measuring tool 18 is moved into and out of subterranean well 10, measuring tool 18 can encounter obstructions within bore 14 that can hinder the movement of measuring tool 18 within bore 14. Treatment platform 24 can include one or more treatment system operable to perform a treatment function within subterranean well 10 during delivery of measuring tool 18 into subterranean well 10.

Figure 4:
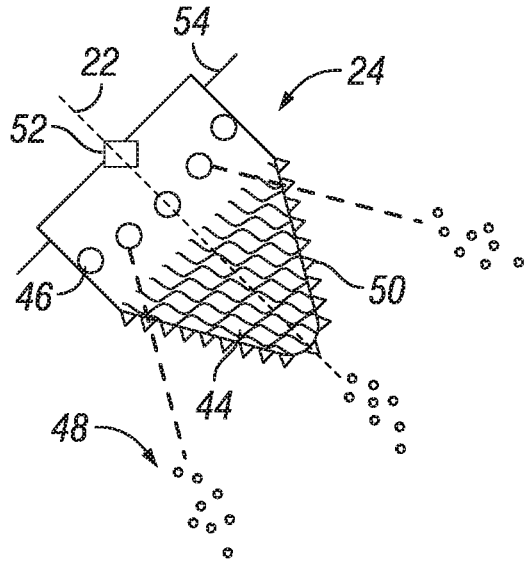
FIG. 4 is a perspective view of a treatment platform, in accordance with an embodiment of this disclosure.
Figure 5:
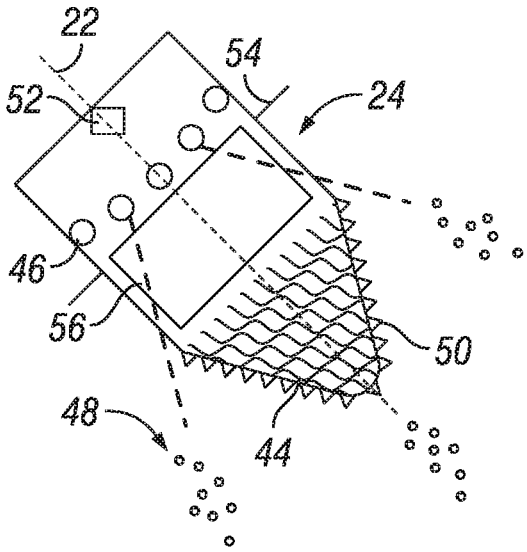
FIG. 5 is a perspective view of a treatment platform, in accordance with an embodiment of this disclosure.

Looking at FIGS. 4-6, treatment platform 24 can include thermal, chemical, and mechanical treatment systems. Thermal treatments systems can include heat delivery system 44. Heat delivery system 44 can heat the obstruction which can be especially helpful in removing an obstruction in wells that are drilled in the arctic or other low temperature region. Heat delivery system 44 can heat the obstruction with, for example, by delivering hot fluids to the obstruction, through thermal conduction, with the use of lasers, or other known heat treatment systems in the art.

A chemical treatment system can include jets 46. Jets 46 can deliver a jet fluid 48 to the obstruction at a high velocity. Jet fluid 48 can, for example, be a fluid that can chemically dissolve the obstruction material and otherwise clean bore 14. Jet fluid 48 can be, for example, an acid based fluid or a reamer. Jet fluid can alternately be an inert fluid that mechanically reduces the obstruction or can wash pieces of the obstruction uphole or downhole or otherwise moved out of the way of measuring tool 18.

A mechanical treatment system of treatment platform 24 can include one or more of vibration, rotation, and a textured surface. Any of the treatment platforms 24 can be vibrated to dislodge obstructions within bore 14. In addition, any of the treatment platforms 24 can be rotated to dislodge obstructions within bore 14. Treatment platform 24 can be, for example, rotated about central axis 22 of measuring tool 18. As an example, when treatment platform 24 is separated from tool body 20, a collapsible motorized tractor having spherical wheels can be used to allow treatment platform 24 to rotate around central axis 22 or move uphole or downhole relative to tool body 20.

One or more of the treatment platforms 24 can include a textured surface 50. Textured surface 50 can engage an obstruction of bore 14 of subterranean well 10 to reduce such obstruction. Textured surface 50 can, for example, grind the obstruction into smaller pieces that can be washed uphole or downhole or otherwise moved out of the way of measuring tool 18. In addition, textured surface 50 can act as a reaming or back reaming in order to smooth out irregularities in bore 14.

Treatment platform 24 can further include a monitoring system for assessing conditions within bore 14. The monitoring system can include camera 52. Camera 52 can be mounted on one or more treatment platforms 24 for visualizing conditions within bore 14. The monitoring system can further include sensors such as calipers 54. Caliper 54 can include a number of elongated members that extend radially outward from treatment platform 24 for mechanically measuring an interior profile of bore 14.

Looking at FIG. 5, treatment platform 24 can alternately include sample storage space 56. Samples from bore 14 can be collected and stored in sample storage space 56 to be returned to the surface for testing or other examination.

In an example of operation, in order to perform logging, measuring, or intervention operations within bore 14, one or more treatment platforms 24 can be delivered into bore 14 as part of measuring tool 18. Treatment platforms 24 can identify and treat obstructions within bore 14 so that measuring tool 18 can travel through bore 14 to perform the required measurement and logging operations. Treatment platforms 24 perform logging, measuring, or intervention operations after drilling of the bore 14 has been completed, or otherwise separate from drilling operations.

Measuring tool 18 of embodiments of this disclosure can improve the performance of measurement and logging operations, in particular in well bores that have obstructions, including waxy materials, filter cakes, and cutting accumulations. Measuring tool 18 can clear such obstructions. Treatment platforms 24 can be stacked at both axial ends of tool body 20 to allow for multiple treatment platforms to be part of measuring tool 18. The use of measuring tool 18 can reduce the need for separate well intervention, and can eliminate the need to run a logging dummy before performing measuring and logging operations.

Embodiments of the disclosure described, therefore, are well adapted to carry out the objects and attain the ends and advantages mentioned, as well as others that are inherent. While example embodiments of the disclosure have been given for purposes of disclosure, numerous changes exist in the details of procedures for accomplishing the desired results. These and other similar modifications will readily suggest themselves to those skilled in the art, and are intended to be encompassed within the spirit of the present disclosure and the scope of the appended claims.

What is claimed is:

1. A system for measuring properties within a subterranean well, the system having:

a measuring tool having a tool body with a central axis and a tool attachment located at an axial end of the tool body;

a delivery line attachment operable to attach the measuring tool to a delivery line that supports the measuring tool within the subterranean well;

a primary treatment platform in mechanical communication with the tool body, the primary treatment platform having:

a platform attachment sized to mate with the tool attachment where the platform attachment is operable to alternately selectively release the primary treatment platform from direct attachment with the tool body, and selectively directly secure the primary treatment platform to the tool body with the tool attachment;

a secondary treatment platform which is detachable from tool body while in the well, where the primary treatment platform is located downhole of the too body and the secondary treatment platform is located uphole of the tool body and wherein the primary treatment platform and secondary treatment platform are configured to treat obstructions in the well; and at least one treatment system, the at least one treatment system operable to perform a treatment function within the subterranean well during delivery of the measuring tool into the subterranean well.

2. The system of claim 1, where the primary treatment platform is rotatable around the central axis.

3. The system of claim 1, where the at least one treatment system includes a vibration system operable to vibrate the primary treatment platform.

4. The system of claim 1, where the primary treatment platform includes a textured surface positioned to engage an obstruction of the subterranean well.

5. The system of claim 1, where the at least one treatment system includes one of a heat delivery, a chemical treatment system, and combinations thereof.

6. The system of claim 1, where the primary treatment platform includes a monitoring system, the monitoring system including one of a camera, a sensor, a caliper, and combinations thereof.

7. The system of claim 1, where the primary treatment platform further includes a sample storage space.

8. The system of claim 1, further including a secondary treatment platform, the secondary treatment platform having a secondary platform connector sized to engage the primary treatment platform.

9. The system of claim 1, where the delivery line is one of a wireline or coiled tubing.

10. The system of claim 1, where the platform attachment circumscribes a portion of the tool body.

11. The system of claim 1, where the primary treatment platform is spaced axially apart, and separate from, the tool body.

12. The system of claim 11, further including a rope extending between the tool body and the primary treatment platform.

13. A method for measuring properties within a subterranean well, the method including:

supporting a measuring tool within the subterranean well with a delivery line, the measuring tool having:

a tool body with a central axis and a tool attachment located at an axial end of the tool body;

a delivery line attachment attaching the measuring tool to the delivery line; and a primary treatment platform in mechanical communication with the tool body, the primary treatment platform having a platform attachment sized to mate with the tool attachment and also having at least one treatment system;

alternately selectively releasing the primary treatment platform from direct attachment with the tool body, and selectively directly securing the primary treatment platform to the tool body with the tool attachment, with the platform attachment;

a secondary treatment platform which is detachable from tool body while in the well, where the primary treatment platform is located downhole of the tool body and the secondary treatment platform is located uphole of the tool body and wherein the primary treatment platform and secondary treatment platform are configured to treat obstructions in the well; and performing a treatment function within the subterranean well with the at least one treatment system during delivery of the measuring tool into the subterranean well.

14. The method of claim 13, further including rotating the primary treatment platform around the central axis.

15. The method of claim 13, where the at least one treatment system includes a vibration system and the method further includes vibrating the primary treatment platform.

16. The method of claim 13, where the primary treatment platform includes a textured surface and the method further includes engaging an obstruction of the subterranean well with the textured surface to remove the obstruction.

17. The method of claim 13, where the treatment system includes one of a heat delivery system, a chemical treatment system, and combinations thereof.

18. The method of claim 13, where the primary treatment platform includes a monitoring system, the monitoring system including one of a camera, a sensor, a caliper, and combinations thereof.

19. The method of claim 13, where the primary treatment platform further includes a sample storage space and the method further includes storing a sample of the subterranean well within the sample storage space.

20. The method of claim 13, where the measuring tool has a secondary treatment platform having a secondary platform connector, the method further including engaging the primary treatment platform with the secondary platform connector to secure the secondary platform connector to the primary treatment platform.

21. The method of claim 13, where the delivery line is one of a wireline or coiled tubing and the method further includes delivering the measuring tool into the subterranean well with the delivery line.

22. The method of claim 13, where the platform attachment circumscribes a portion of the tool body.

23. The method of claim 13, where the primary treatment platform is spaced axially apart, and separate from, the tool body.

24. The method of claim 23, where a rope extends between the tool body and the primary treatment platform.

* * * * *